US006161775A

United States Patent [19]

Brown et al.

[11] Patent Number: 6,161,775

[45] Date of Patent: Dec. 19, 2000

[54] FEEDLINE ASSEMBLY AND ASPHALT CIRCULATION SYSTEM FOR AN ASPHALT DISTRIBUTOR

[75] Inventors: Thomas R. Brown, Oregon; Jeremey Heller, Dixon; Patrick O'Brien, Oregon, all of Ill.

[73] Assignee: E. D. Etnyre & Co., Oregon, Ill.

[21] Appl. No.: 09/256,482

[22] Filed: Feb. 23, 1999

[51] Int. Cl.[7] ..... B05B 1/24

[52] U.S. Cl. ..... 239/132.1; 239/159; 239/160

[58] Field of Search ..... 239/125, 168, 239/157, 159, 127, 132.1, 130, 133, 160; 299/34

[56] References Cited

U.S. PATENT DOCUMENTS

| | | | |
|---|---|---|---|
| 1,778,551 | 10/1930 | Etnyre . | |
| 2,011,894 | 8/1935 | Etnyre | 299/34 |
| 2,046,373 | 7/1936 | Etnyre | 299/34 |
| 2,372,065 | 3/1945 | Etnyre | 299/34 |
| 2,472,199 | 6/1949 | Etnyre | 299/34 |
| 2,505,390 | 4/1950 | Etnyre | 299/34 |
| 2,571,850 | 10/1951 | Etnyre | 299/34 |
| 2,599,704 | 6/1952 | Etnyre | 299/34 |
| 3,239,148 | 3/1966 | Etnyre | 239/159 |
| 3,838,817 | 10/1974 | Hill | 239/125 |
| 4,274,586 | 6/1981 | Hill | 239/125 |
| 4,817,870 | 4/1989 | Dalton | 239/157 |
| 4,960,242 | 10/1990 | Larson | 239/168 |
| 5,827,360 | 10/1998 | Salminen | 106/273.1 |

*Primary Examiner*—Joseph A. Kaufman
*Assistant Examiner*—David Deal
*Attorney, Agent, or Firm*—Leydig, Voit & Mayer

[57] ABSTRACT

A feed line assembly includes adjacent running or coaxial delivery and return conduits for transferring asphalt between a spray bar and a pump and tank of an asphalt distributor. The coaxial feed line assembly provides for one directional flow in each of the feed lines between the spray bar and the asphalt tank/pump. The circulating system can be operated in spraying and circulating modes. Asphalt flows through the delivery conduit to the spray bar and out through nozzles in the spraying mode and asphalt flows from the delivery conduit through the spray bar and is returned through the return conduit in the circulation mode. Asphalt is substantially static in the return conduit during the circulation mode. The coaxial feed line assembly serves as a heat exchanger to transfer heat from the delivery conduit to the return conduit and thereby prevent freezing of substantially static asphalt in the return conduit during spraying mode. A pressure differential between spraying and circulation modes control the position of a pressure relief valve connected to the return conduit to thereby control the flow through the circulating system.

19 Claims, 8 Drawing Sheets

ASPHALT TANK
30

21
HANDSPRAY
47
48
OFF-LOADING
27
44
40
46
45
20
27
36
27
32
34
22
DIRECTIONAL CONTROL VALVE
42
43
LOADING
38
26
52
62
24
54
53
50
58
55
28A
29
28
58
28B
56
56
56
59
31
59

ASPHALT TANK
30

TRANSFER
21
HANDSPRAY
47
48
OFF–LOADING
27
44
40
46
45
22
20
27
36
27
32
34
42
43
LOADING
38
26
52
62
24
54
53
50
58
55
28A
29
28
58
28B
56
56
56
59
31
59

ASPHALT TANK
30

RECIRCULATION
21
HANDSPRAY
47
48
OFF-LOADING
27
44
40
46
45
22
20
27
36
27
32
34
42
43
LOADING
38
26
52
62
24
54
53
50
58
55
28A
29
28
58
28B
56
56
56
59
31
59

ASPHALT TANK
30

CIRCULATION THRU SPRAY BAR
21
HANDSPRAY
47
48
OFF-LOADING
44
27
40
46
45
22
20
27
36
27
32
34
42
43
LOADING
38
26
52
62
24
54
53
50
58
55
28A
29
28
58
28B
56
56
56
59
31
59

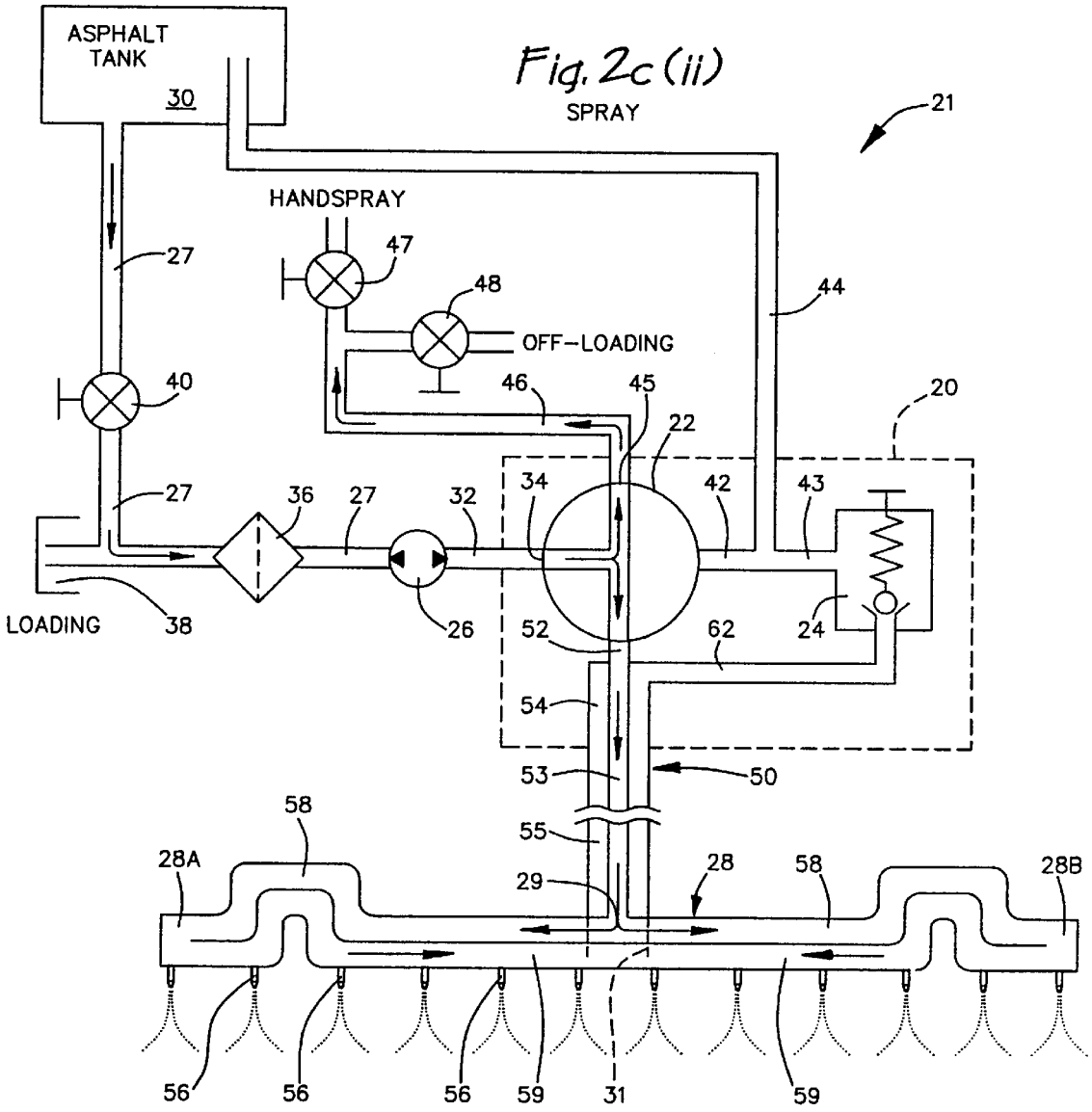
ASPHALT TANK
30
Fig. 2c (ii)
SPRAY
21
HANDSPRAY
47
48
OFF-LOADING
27
44
40
46
45
20
22
27
36
27
32
34
42
43
LOADING
38
26
52
62
24
54
53
50
58
55
28A
29
28
58
28B
56
56
56
59
31
59

FEEDLINE ASSEMBLY AND ASPHALT CIRCULATION SYSTEM FOR AN ASPHALT DISTRIBUTOR

FIELD OF THE INVENTION

The present invention generally relates to asphalt distributors and more particularly relates to asphalt circulation systems of asphalt distributors.

BACKGROUND OF THE INVENTION

Asphalt distributors apply hot liquid asphalt to road and other surfaces in a variety of paving applications. Upon cooling, asphalt material becomes more viscous and eventually "freezes" to provide a binder material for pavement. Although it is desired that asphalt freezes upon spray application, it is important to prevent cooling of the asphalt material before spraying, while the asphalt is in the distributor. If asphalt freezes in the distributor, the asphalt can cause serious operating problems such as plugging the system and decreasing uniformity of the spray application.

Asphalt distributors conventionally include a tank, a pump, a spray bar and the plumbing network for communicating asphalt from the tank through the pump to the spray bar. The tank, pump and spray bar are conventionally supported directly by a vehicle such as a truck or supported by a detachable trailer pulled behind the vehicle. The plumbing network of an asphalt distributor preferably performs a number of desired functions, including loading of asphalt into the tank, off-loading asphalt out of the tank, transfer to handspray operations, circulating asphalt in the tank during initial asphalt heating, spraying of asphalt, and circulating asphalt through the spray bar while not spraying to prevent freezing of asphalt therein.

A prior attempt of providing an asphalt distributor is exemplified by Hill, U.S. Pat. No. 4,274,586. Hill provides a circulating system that includes dual feed lines connecting the pump to the spray bar, each feed line being connected near one end of the spray bar. In Hill, flow through one feed line is positive or one directional while the flow through the other feed line is positive or negative (bidirectional) depending upon whether spraying or circulation through the bar is desired. During normal spraying operations, flow through both feed lines is positive to deliver asphalt flow to the spray bar. However, when the distributor is stopped, flow through the bidirectional feed line is typically reversed to circulate asphalt through the spray bar and back to the tank to continuously move the asphalt through the feed lines and spray bar and prevent asphalt from freezing therein. Switching the flow is accomplished with an intermediate conduit having an on/off valve therein selectively connecting the feed lines, an adjustable pressure relief valve in the bidirectional feed line, and a pair of on/off valves in the spray bar.

Problems existing in the art relate to the complexity and cost of providing the circulating network in the asphalt distributor. Prior attempts have typically required complex and multiple valves and extensive lengths of circulating plumbing to reverse the flow of asphalt in one of the feed lines and provide the desired operating functions of an asphalt distributor, while all the time preventing asphalt from freezing and plugging the system. Not only are complex valves expensive but the multiple valve locations which are dictated by the routing of interconnecting plumbing do not provide easy operation or straightforward understanding of operation. For manually operated valves, this requires extra worker training and presents a potential safety hazard. The multiple connections can be prone to assembly difficulties and leaks, and the multiple lengths of exposed plumbing result in excessive heat loss from the asphalt which can lead to freezing or plugging of the system.

SUMMARY OF THE INVENTION

It is therefore the general aim of the present invention to reduce the complexity and cost of providing a circulating system in an asphalt distributor.

It is another aim of the present invention to eliminate the need to reverse the flow in one of the feed lines to the spray bar in the circulating system of an asphalt distributor.

It is an object of the present invention to reduce the lengths of exposed plumbing and potential for leaks in a circulating system of an asphalt distributor.

It is a subsidiary object to reduce the number and complexity of valves required to provide for desired operating modes of an asphalt distributor.

In that regard, it is a further objective of the present invention to provide a circulating system in an asphalt distributor that is easier to use, and therefore which is safer to workers.

To achieve the foregoing aims and objects, the present invention is directed to an improved circulating system including a feed line assembly having a delivery conduit and a return conduit, each for one directional flow during spraying and spraybar circulation modes. The feed line assembly includes a delivery conduit disposed transversely between a pump and a spray bar that delivers pumped asphalt to the spray bar during spraying and circulation modes. The feed line assembly includes a return conduit disposed transversely between the spray bar and the tank for returning asphalt from the spray bar to the tank during the circulation mode. The return conduit and the delivery conduit run adjacent with one another to act as a heat exchanger and transfer heat sufficient to prevent freezing of substantially static asphalt remaining in the return conduit during the spraying mode.

According to the preferred embodiment, the improved circulation system includes a pressure relief valve connected to the return conduit. The pressure relief valve prevents return of asphalt flow during spraying mode and allows return of asphalt flow during bar circulation mode. More particularly, a pressure differential exists between the spraying mode and the circulation mode due to the open or closed nature of the nozzles. High pressure causes the pressure relief valve to open during the circulation mode to flow asphalt from the spray bar to the tank while low pressure causes the pressure relief valve to close during the spraying mode to prevent asphalt from flowing through the return conduit. The return conduit runs adjacent to the delivery conduit forming a heat exchanger mechanism to prevent freezing of asphalt in the circulating system.

It is an aspect of the present invention that the circulation system includes a directional control valve that connects the delivery conduit and the pump for selectively operating the circulation system in spraying, spray bar circulation and tank recirculation modes. It is a further aspect that the feed line assembly connects in close proximity to the center of the spray bar which simplifies the construction and the spray bar and provides for continuous positive circulation through this spray bar without the need to reverse the flow through the spray bar.

It is another feature of the present invention to provide a coaxial feed line assembly in an asphalt circulation system of an asphalt distributor. The feed line assembly is disposed transversely between the spray bar and the pump and tank for transferring asphalt therebetween. The coaxial feed line assembly includes first and second conduits for communicating asphalt. The first and second conduits are disposed coaxial thereby limiting the amount of exposed plumbing and forming a heat exchanger mechanism to transfer heat between conduits to prevent freezing of asphalt in the asphalt distributor. It is an advantage that the coaxial feed line assembly reduces the lengths of exposed plumbing, thereby reducing the heat loss and the potential for external leaks. It is another advantage that the coaxial feed line assembly allows asphalt to be substantially static in one line while asphalt is flowing through the other line.

These and other objects and advantages of the invention will become more apparent from the following detailed description when taken in conjunction with the accompanying drawings.

Figure 1:
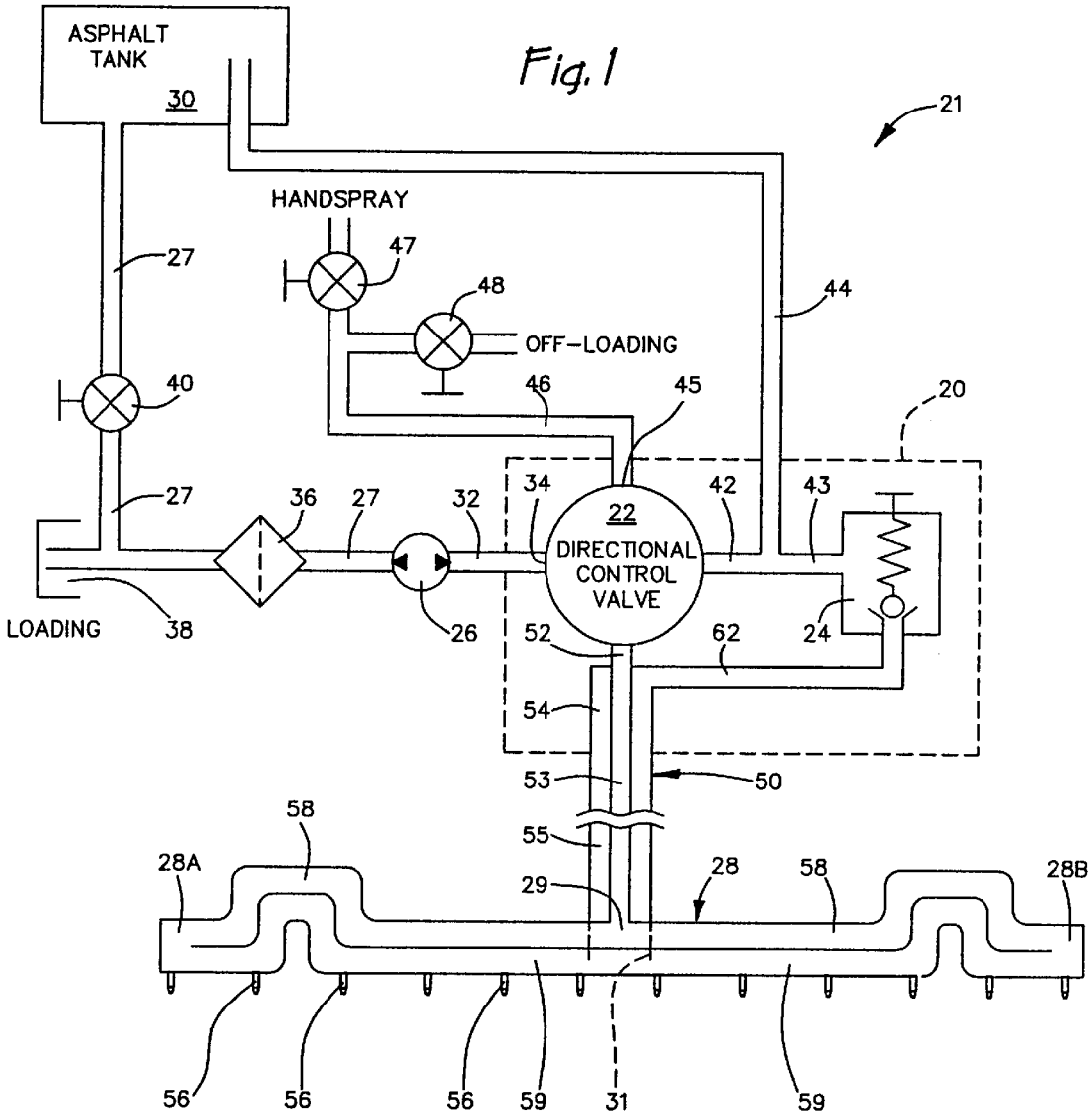
FIG. 1 is a schematic illustration of a coaxial feed line assembly and improved circulating system according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration and referring to FIG. 1, a coaxial feed line assembly 50 and an improved asphalt circulating system 21 of a vehicular asphalt distributor is illustrated in accordance with a preferred embodiment of the present invention. In the preferred embodiment, a modular control valve assembly 20 including a directional control valve 22 and a pressure relief valve 24 controls the alternative flow paths of asphalt through the coaxial feed line assembly 50 and the rest of the circulating system 21.

The circulating system 21 includes a pump 26 for pumping asphalt through the system, a spray bar 28 for discharging asphalt, and plumbing and valving therebetween to provide for several operating modes as will be explained. As shown, the pump 26 is preferably bidirectional so that asphalt flow may be reversed and sucked back from the circulating system 21 after a worksite or workday is completed. The pump 26 is connected by a supply line 27 to an asphalt tank 30 and by a pump output conduit 32 to an inlet 34 of the directional control valve 22. Disposed along the supply line 27, arc a strainer 36 for removing frozen asphalt chunks and large impurities which could clog the circulating system 21, a quick disconnect coupling 38 for tank filling operations, and a tank valve 40 for selectively shutting off flow from the tank 30. Within the modular control valve assembly 20, the directional control valve 22 and pressure relief valve 24 have return outlet ports 42, 43 that are connected to form a single return or recirculating line 44 to the asphalt tank 30. The directional control valve 22 includes a transfer outlet 45 connected to a transfer line 46 for handspray and/or asphalt off-loading operations. Flow through the transfer line 46 and to handspray and off-loading outputs is controlled by on/off type valves 47, 48. The modular control valve assembly 20 is connected by a feed line assembly 50 to the spray bar 28 for transferring asphalt to and from the spray bar 28. The directional control valve has a delivery outlet 52 and a return inlet 54 connected with the feed line assembly 50. As shown, the feed line assembly 50 is generally disposed transversely between the tank 30 and the spray bar 28 and connects preferably near the center of the spray bar 28 and orthoganally thereto. The feed line assembly 50 includes a delivery conduit 53 for delivering asphalt to the spray bar and a return conduit 55 for returning asphalt therefrom. The spray bar 28 includes an inlet 29 connected to the delivery conduit 53 and an outlet 31 connected to the return conduit 55. The spray bar 28 also has a plurality of solenoid actuated on/off type nozzles 56 linearly aligned between manifold ends 28A, 28B for uniformly discharging asphalt over a selected surface area. As schematically shown in FIG. 1, the spray bar 28 is split into adjacent flow passages with a first top passage 58 from the delivery conduit 53 to the ends 28A, 28B of the spray bar 28 and a second bottom passage 59 from the ends 28A, 28B of the spray bar 28 to the return conduit 55. This provides for continuously positive flow through the spray bar 28 without the need to reverse the flow of asphalt therein. In a preferred embodiment, the bottom passage 59 and outlet 31 are disposed vertically below the top passage 58 and inlet 29 as can be seen better in FIG. 3 and as will be later described in further detail. By connecting the delivery conduit 53 near the center of the spray bar 28 as schematically shown, the pressures at the ends 28A, 28B are substantially equal pressures throughout the length of the spray bar thereby providing for substantially uniform spraying. It is an advantage that this configuration simplifies construction of the spray bar and minimizes the cost necessary in building the spray bar.

Figure 2A:
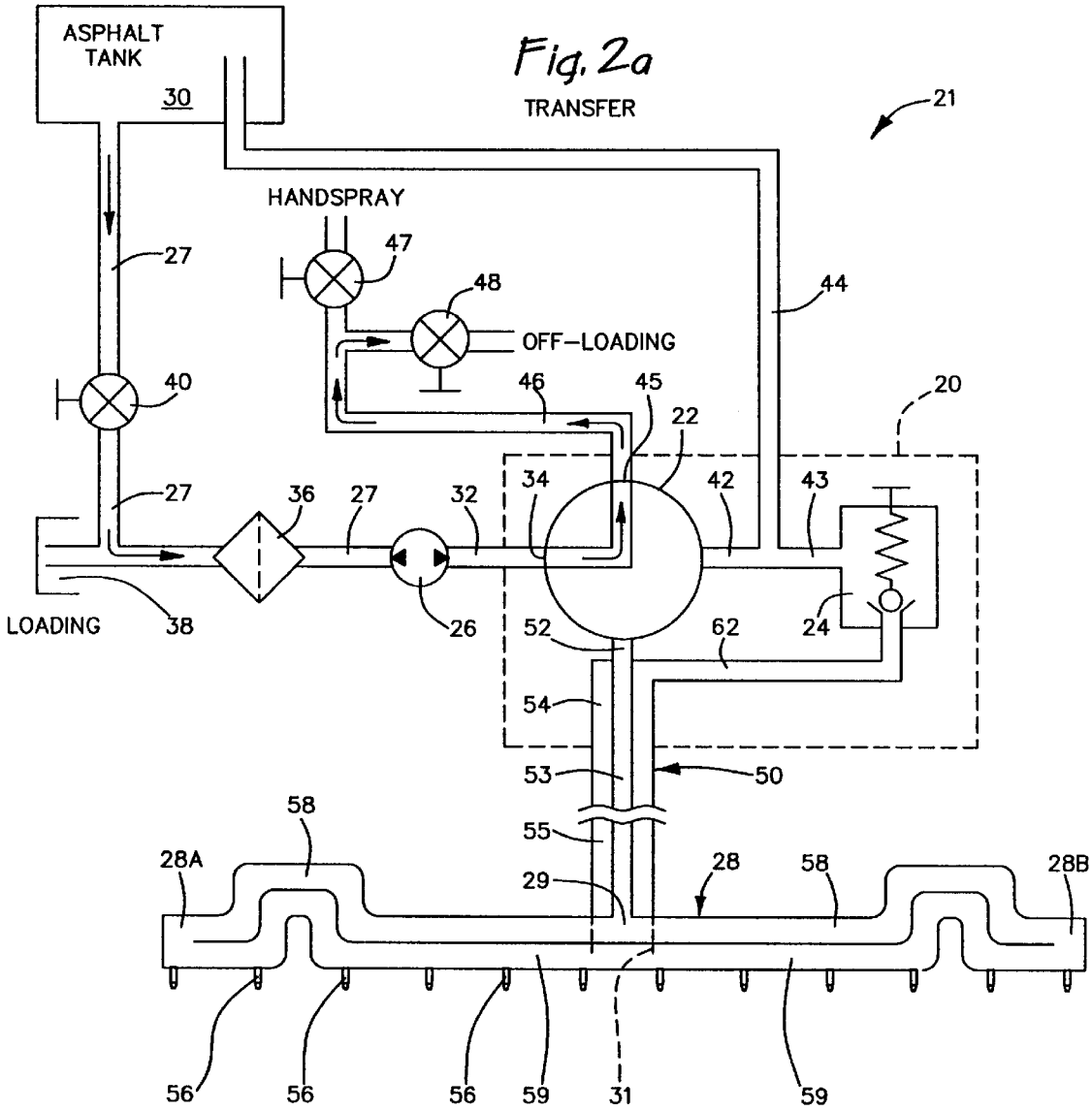
FIGS. 2A, 2B, 2C(i) and 2C(ii) are schematic flow diagrams illustrating the multiple positions and alternative flow paths in the circulating system of FIG. 1.
Figure 2B:
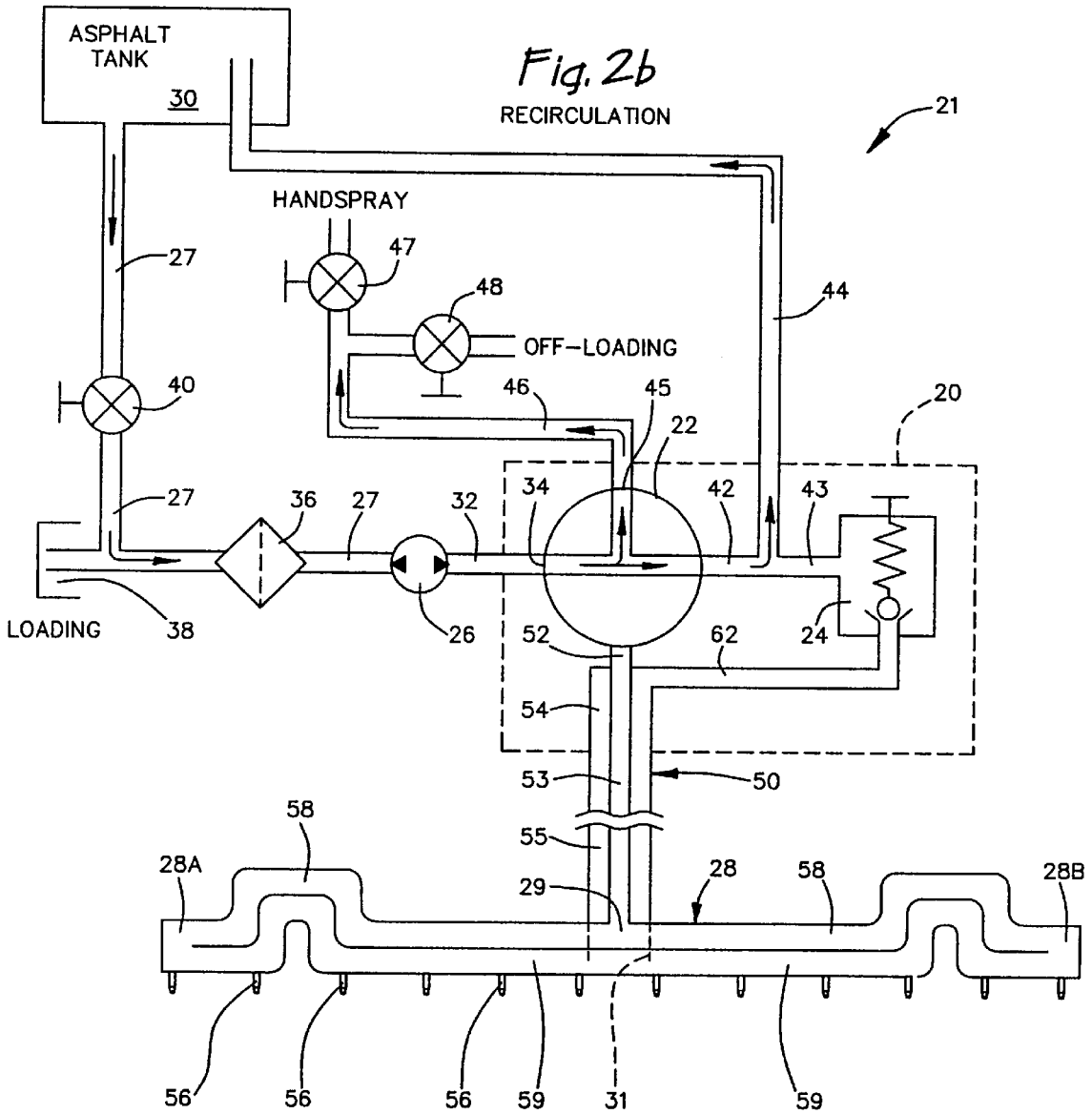
Figure 2C:
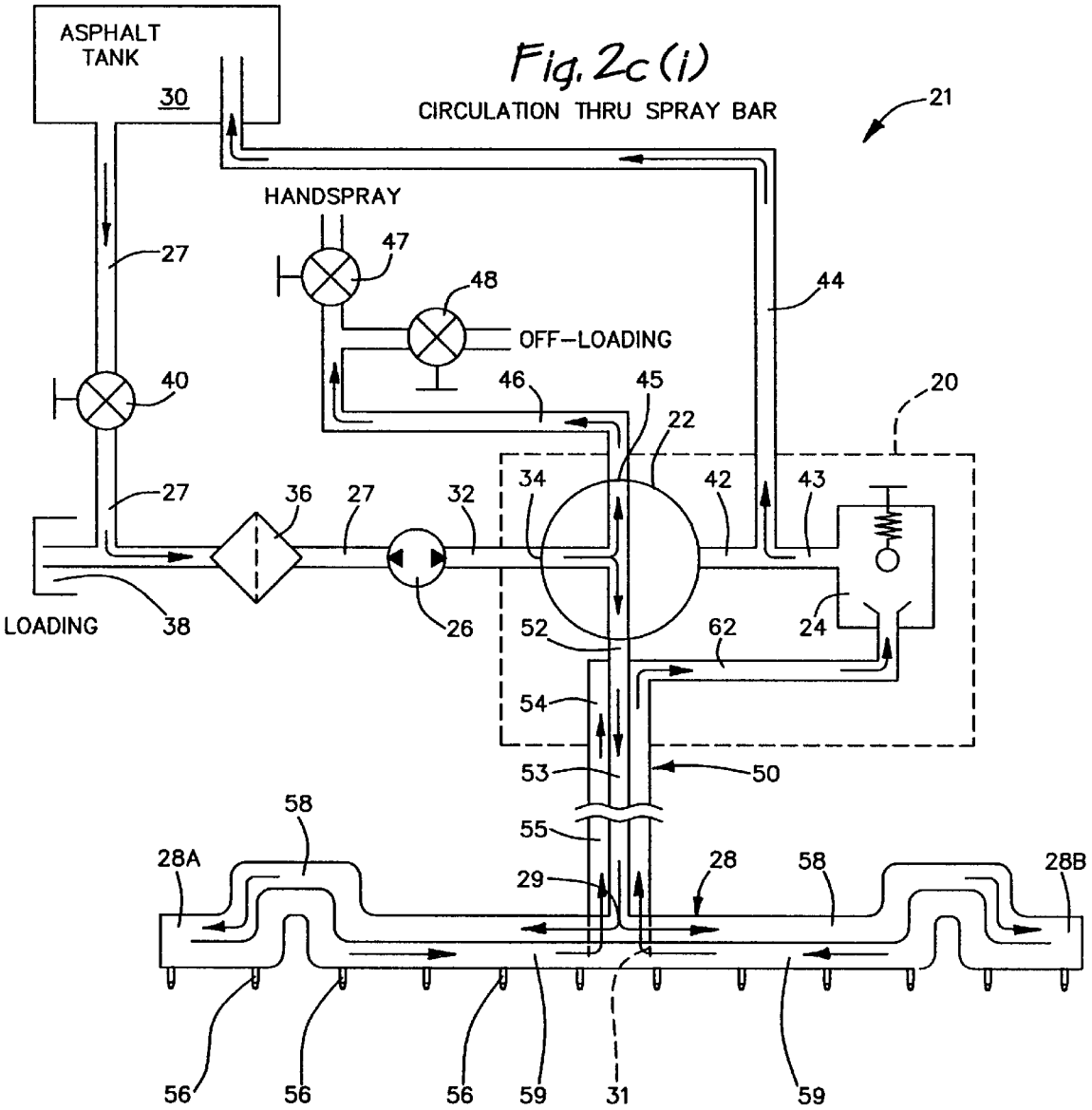

Referring to FIGS. 2A, 2B, 2C(i) and 2C(ii), the directional control valve 22 has three positions for directing the flow of asphalt through circulating system 21. In the first position shown in FIG. 2A. the pump 26 is connected to the transfer line 46 for selectively off-loading and handspray operations and is disconnected from the delivery conduit 53 and the recirculating line 44. In this position, workers can selectively operate valves 47, 48 for hand spray and off-loading operations. In the second position shown in FIG. 2B, the directional control valve 22 connects the pump 26 to the recirculating line 44 while disconnecting the pump from the delivery conduit 53 for tank recirculation mode and tank loading operation. During recirculation mode, asphalt is pumped from the tank 30 to the directional control valve 22 and back to the tank 30 without going through the spray bar 28. Recirculation mode is normally done during initial startup to heat the asphalt and warm up a portion of the circulating system 21. During tank loading operations, an external supply line is connected to the quick disconnect coupling 38 whereby the pump 26 delivers asphalt to the tank through the directional control valve 22 and return line 44.

In the third position shown in FIG. 2C(i) and 2C(ii), the directional control valve 22 connects the pump 26 to the delivery conduit 53 while disconnecting the pump from the recirculating line 44 for spray bar circulating and asphalt spraying modes. In accordance with the aim of eliminating the need to reverse the flow of asphalt in one of the feed lines of the feed line assembly, the circulating system 21 of the preferred embodiment provides for one directional flow in each of the return and delivery conduits 53, 55 during spraying and spray bar recirculation operations. During spray bar circulation mode shown in FIG. 2C(i), the nozzles 56 are closed which raises the pressure of asphalt in the spray bar 28 and thereby the pressure at the pressure relief valve 24 causing it to open past its cracking point. This allows the asphalt to flow from the return conduit 55 through the recirculating line 44 and back into the tank 30. Spray bar circulation mode is typically used during initial warming up of the spray bar 28 and nozzles 56 as well as during standby or breaks in operation as when the asphalt distributor is stationary. During the spraying modes shown in FIG. 2C(ii), the directional control valve 22 is in the same position as for the spray bar circulation mode, however, the nozzles 56 are open for discharging the asphalt over a selected surface. With the nozzles 56 open, the pressure in the spray bar 28 is released thereby lowering the asphalt pressure causing the pressure relief valve 24 to close. The cracking point of the pressure relief valve 24 is set between the respective asphalt pressures corresponding to the spray bar circulation and the spraying modes.

In viewing FIG. 2C(ii) of the preferred embodiment, it can be seen that asphalt does not readily flow through the return conduit 55 during the spraying mode. The pressure relief valve 24 or other means such as a selectively operated on/off valve prevents flow through the return conduit 55 during spraying mode, whereby asphalt is substantially static in the return conduit during circulation mode. It is an advantage that the preferred embodiment prevents freezing of the static asphalt in the return conduit 55 by running the delivery conduit 53 coaxial or otherwise adjacent with the return conduit 55 thereby forming a heat exchanger mechanism. More specifically, residual asphalt remains in the return conduit 55 and is substantially static or non-mobile therein during the spraying mode. The residual asphalt is heated through heat transfer from the delivery conduit 53 by the asphalt flowing therethrough. It is another advantage that the directional control valve 22 does not need to reverse the flow of asphalt in either of the conduits 53, 55 of the feed line assembly 50 during the operating modes thereby providing for one directional flow. As used herein, one directional flow refers to the direction of active asphalt flow during bar circulation and spraying modes (thus not to be confused with optional suckback operation in which flow is reversed). It is another advantage that the preferred embodiment provides for fewer and less complex valves and reduces the exposed lengths of plumbing while providing for numerous desired operating modes of the asphalt distributor. This also reduces the potential for external asphalt leaks.

Figure 3:
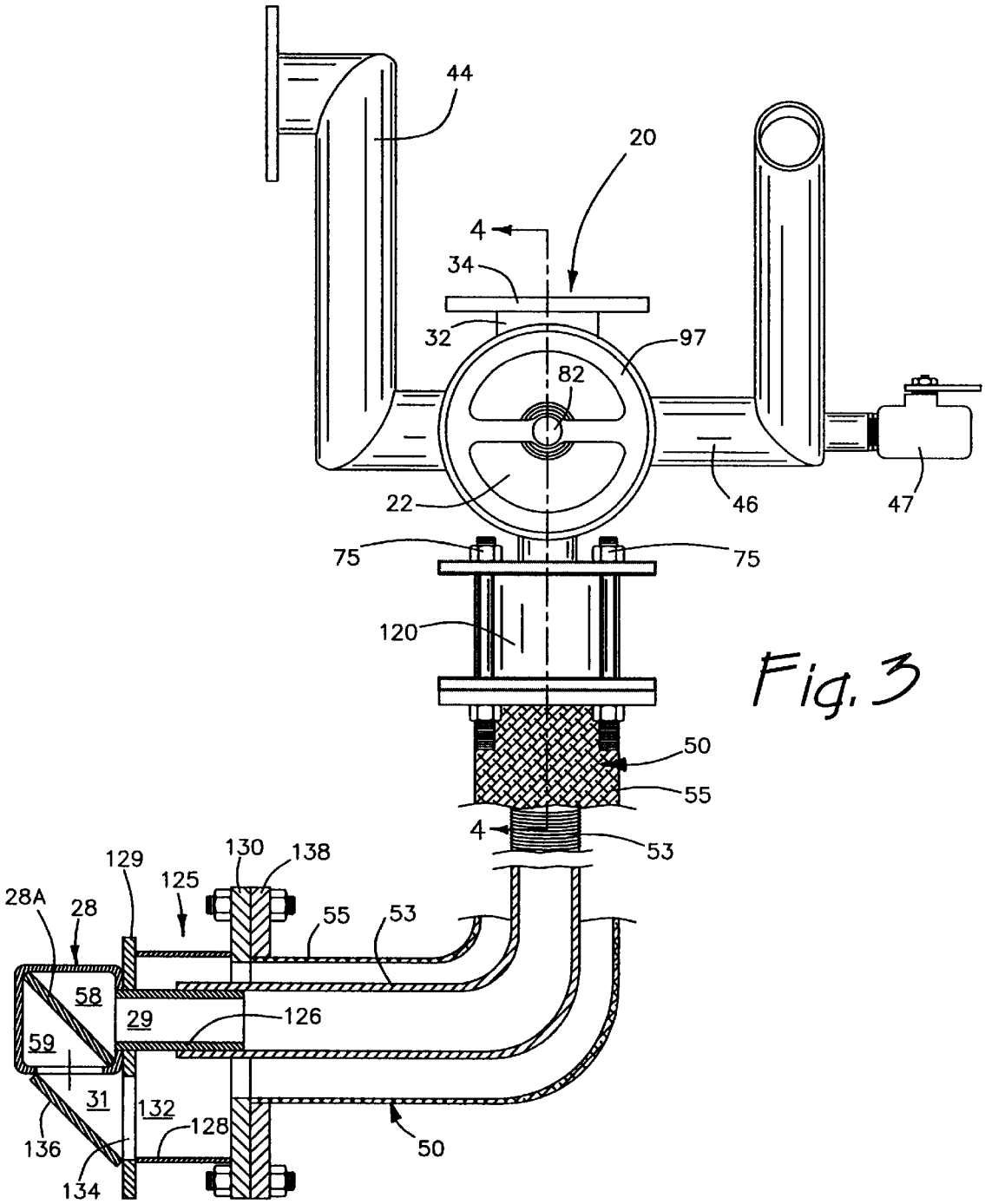
FIG. 3 is a side view of a modular control valve assembly and cross sectional view of a spray bar assembly with a coaxial feed line assembly connecting the assemblies according to a preferred embodiment of the present invention.
Figure 4:
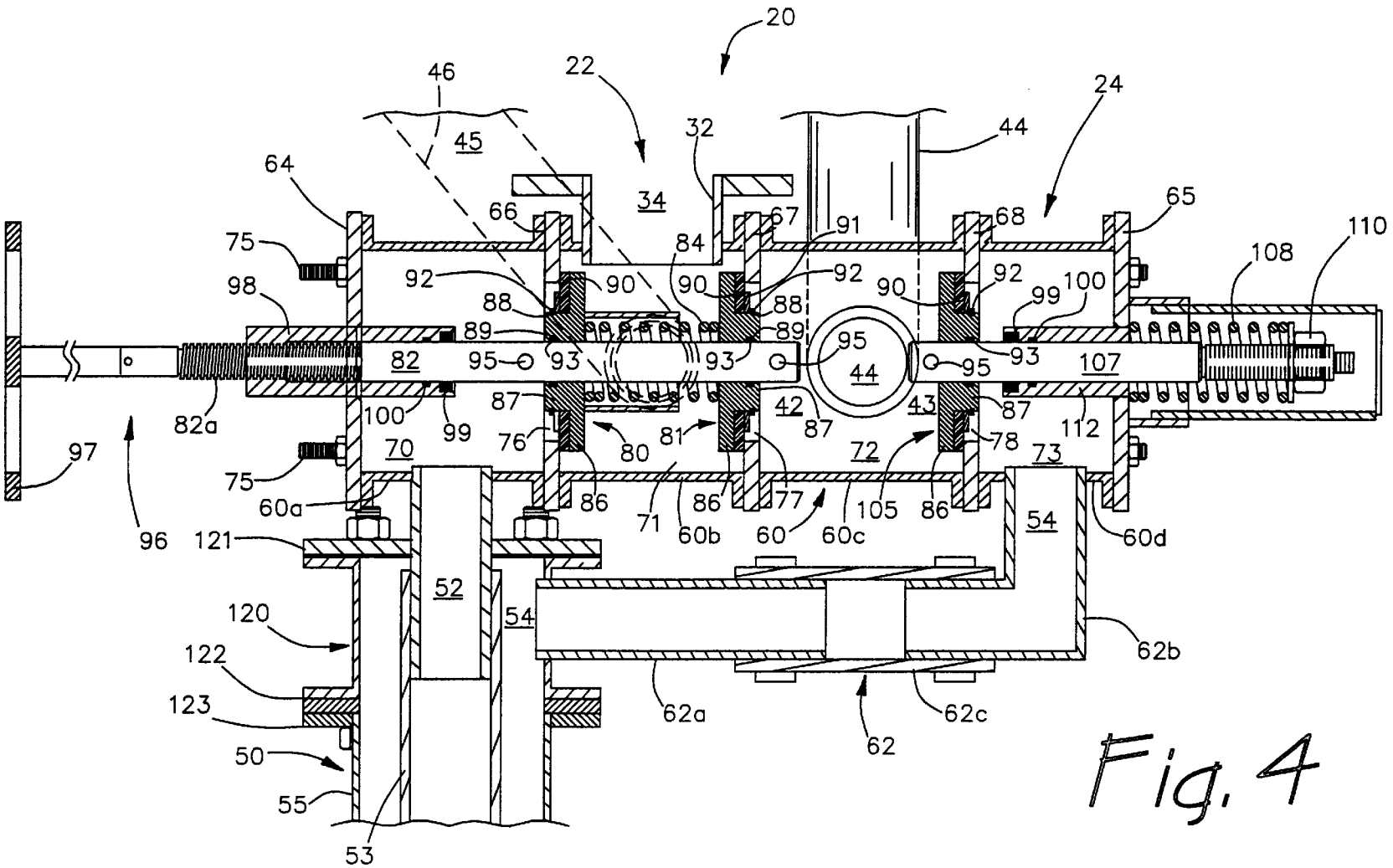
FIG. 4 is a cross-sectional view of the modular control valve assembly of FIG. 3 taken about line 4—4 showing a coaxial outlet connection to a coaxial feed line assembly.

Turning now to FIGS. 3 and 4, a preferred mechanical implementation of the feed line assembly 50 is shown connecting the spray bar 28 with the modular control valve assembly 20. The modular control valve assembly 20 provides an elongate tube-like valve body 60 with a directional control valve generally indicated at 22 and a pressure relief valve generally indicated at 24, both housed therein. The valve body 60 has various pipes welded or otherwise fixed to the body to provide an inlet 34 for receiving pumped asphalt from the pump 26 (FIG. 1), an outlet 44 for returning asphalt to the tank 30 (FIG. 1), a delivery outlet 52 connected to the delivery conduit 53 for delivering asphalt to the spray bar 28 (FIG. 1), and a return inlet 54 connected to the return conduit 55 for receiving circulated asphalt from the spray bar 28 (FIG. 1). An extension line 62 extends the bar feed return inlet 54 to the pressure relief valve 24. In the preferred embodiment, the extension line includes two metal pipes 62*a*, 62*b* and a temperature resistant flexible hose 62*c* clamped therebetween to allow for thermal expansion or misalignments. Fixed on the ends of the valve body 60 are flange-like shaft mounting plates 64, 65, with valve seating plates 66, 67, 68 linearly and parallelly spaced and fixed therebetween. Connecting adjacent shaft mounting plates 64, 65 and valve seating plates 66, 67, 68 are tubular body segments 60*a*, 60*b*, 60*c*, and 60*d* which may be formed relatively cheaply from sheet steel with radially outward flange ends abutted against their respective plates 64–68. Each body segment 60*a*–60*d* contains a respective fluid chamber 70, 71, 72, 73. Running through the shaft mounting plates 64, 65 and the valve seating plates 66–68 on the outside of the valve body 60 is a tie rod assembly 75, that includes several nuts and bolts which ties or clamps the modular control valve assembly 20 together, preferably along with gaskets (not shown) disposed between the body segments 60*a*–60*d* and adjacent plates 64–68 for preventing leakage. As shown in FIG. 4, the fluid chambers 70–73 are in fluid communication with the delivery outlet 52, the inlet 34, the recirculating outlet 44 and return inlet 54, respectively. Each valve seating plate 66–68 defines an annular flow orifice 76, 77, 78 for selectively connecting the chambers 70–73.

To control the flow through the directional control valve 22, the preferred embodiment provides two annular valve members 80, 81 or other movable operator for selectively plugging the respective flow orifices 76, 77. The two valve members 80, 81 are slidably mounted over a linearly translatable screw drive shaft 82. A centering spring 84 concentrically disposed over the shaft 82, or other resilient means, urges the valve members 80, 81 in opposite directions against there respective seating plates 66, 67. In the preferred embodiment, each of the valve members 80, 81 includes a plate portion 86 for seating against the respective seating plates 66, 67 and an axially projecting stem portion 87 that is received into a respective flow orifice 76, 77 for partially plugging the respective flow orifices 76, 77. Each stem portion 87 includes an outer groove 88 and an inner groove 89. Disposed between the valve members 80, 81 and the seating plates 66, 67 are disc shaped gaskets 90 for sealing off the inner chamber 71 from the outside chambers 70, 72 of the directional control valve 22. The gaskets 90 are held in place by retainer discs 91 and snap rings 92 or other such retaining means. The snap rings 92 are fitted in the outer periphery groove 88 to hold the retainer discs 91 and gaskets 90 against the valve members 80, 81. A ring gasket 93 is carried in the inner groove 89 to prevent leakage between the drive shaft 82 and the valve members 80, 81.

The position of the drive shaft 82 determines the position of the valve members 80, 81. A pair of spring pins 95 or other radially projecting members are linearly spaced and fixed on the drive shaft 82 for selectively engaging the valve members 80, 81 as the drive shaft 82 moves. As the shown and oriented in FIG. 4, neither of the spring pins 95 are engaging the valve members 80, 81 which keeps the flow orifices 76, 77 closed and the inlet 34 disconnected from the recirculating and delivery outlets 44, 52, thereby providing for asphalt flow diagramed in FIG. 2A. As the drive shaft 82 moves to the right, the left spring pin 95 engages the left valve member 80 lifting it off the seating plate 66 and compressing the centering spring 84, which provides for asphalt flow diagramed in FIGS. 2C(i) and 2C(ii), depending upon the state of the nozzles 56. Likewise, as the drive shaft 82 moves to the left, the right spring pin 95 engages the right valve member 81 lifting it off the seating plate 67 and compressing the centering spring 84, which provides for asphalt flow diagramed in FIG. 2B. As the drive shaft 82 linearly translates, the centering spring 84 engages the valve members 80, 81 to close the open valve member before allowing the other valve member to open, thereby providing a third position in which the valve members 80, 81 close both flow orifices 76, 77.

Although two different controls and other control means may be used for each valve member of the directional control valve 22, the directional control valve 22 preferably has a single control generally indicated at 96 for controlling the position of the drive shaft 82 to thereby provide for the three positions of the directional control valve 22. It is an advantage that providing a single control 96 reduces the complexity of the circulating system which increases worker understanding of how to operate the circulating system 21, and in turn increases worker safety.

In the preferred embodiment, the control 96 comprises a manually operated wheel 97 coupled to the drive shaft 82 outside the valve body 60. The drive shaft includes a threaded portion 82*a* which is received in a corresponding rotationally fixed threaded sleeve portion 98 of the actuator mounting plate 64. As the wheel 97 and drive shaft 82 rotate, the threads 82*a* of the drive shaft 82 engage the threads of the sleeve portion 98 causing the drive shaft 82 to linearly translate. The sleeve portion 98 also carries a scraper 99 and a ring gasket 100 to prevent asphalt from interfering with the rotation of the drive shaft 82 relative to the sleeve portion 98. In an alternative embodiment, a single control 96 is provided by a single three position pneumatic cylinder (not shown) or other fluid or electrical actuator for linearly translating a drive shaft without rotation. It is an advantage of the alternative embodiment that the control may be remotely controlled.

Also shown in FIGS. 3 and 4 is that the directional control valve 22 includes a transfer outlet 45 and conduit 46 connected to the intermediate fluid chamber 71 for continuous connection to the pump 26 (FIG. 1) during all three positions of the directional control valve 22. Although the transfer line outlet conduit 46 may alternatively be placed upstream of the directional control valve 22, connecting the transfer line 46 directly to the directional control valve 22 has the advantage of increasing heat transfer to other portions of the directional control valve 22 and modular control valve assembly 20 when both valve members 80, 81 are in the closed positions. The increased heat transfer prevents freezing of asphalt in the modular control valve assembly 20 during transfer operations.

In furtherance of the objects of reducing the potential for asphalt leaks and freezing or clogging of the circulation network, the preferred embodiment configures the directional control valve 22 with the pressure relief valve in the same valve body 60 to form the modular control valve assembly 20. In particular, heat transfer through the valve body 60 prevents asphalt freezing in the pressure relief valve 24 when it is not open. Also, the pressure relief valve 24 and directional control valve 22 share intermediate return chamber 72 and the recirculating outlet and line 44, thereby further reducing the lengths of plumbing needed to provide for the circulating system 21.

In the preferred embodiment, the pressure relief valve 24 comprises a valve member 105 mounted on a linearly translatable retaining shaft 107 for engaging the valve seating plate 68 and plugging the respective flow orifice 78. Like the directional control valve 22, associated with the valve member are a disc gasket 90, a retainer disc 91, a snap ring 92, and a inner gasket 93, whose function at this point is understood from the above discussion. A spring pin 95 fixed on the retaining shaft 107 continuously engages the valve member 105. More specifically, a spring 108 engages a nut 110 on the retaining shaft 107 to bias the retaining shaft 107 and valve member 105 against the valve seating plate 68. The spring 108 is compressed between the nut 110 and a mounting sleeve portion 112 of the mounting plate 65 for determining the cracking point at which the valve member 105 will open. Also shown in FIG. 4 are a scraper 99 and gasket 100 carried by inner sleeve 112 for preventing asphalt from interfering with the smooth linearly translation of the retaining shaft 107.

As described above, the pressure relief valve 24 opens during spray bar circulation mode and closes during spraying mode. To provide for this, the cracking point of the pressure relief valve 24 is determined by pre-setting the compression in the spring 108. The nut 110 can be tightened or loosened as desired to control the spring compression and thereby the cracking point of the pressure relief valve 24. It is an advantage that during normal operation of switching between spraying and spray bar circulating modes, the spring compression or cracking point does not need to be adjusted. However it will be appreciated that operating conditions can be different on different days. For example, colder weather often causes an increase in asphalt viscosity which may change the pressure applied to the pressure relief valve 24 in different modes. This may require a minor adjustment of the spring compression or cracking point to compensate for changes in operating pressures. The modular control valve assembly 20 also has a coaxial inlet/outlet connection generally indicated at 120 that connects with the coaxial feed line assembly 50. In the preferred embodiment, the connection 120 includes the outlet pipe 52 and the return inlet body 54. The extension line 62 connects the return inlet body 54 with the pressure relief valve 24. The delivery conduit 53 of the feed line assembly is closely and slidably fitted over the outlet pipe 52 while the return conduit 55 and the return inlet body 54 includes respective flange portions 121, 122, 123 that are tied together by a tie rod assembly 75 disposed on the outside of the return inlet body 54. The return and delivery conduits 53, 55 of the feed line assembly 50 are preferably built from flexible metal tubing such as commercially available tar and asphalt hose. Advantageously, the preferred embodiment forms a heat exchanger by coaxially disposing the return and delivery conduits 53, 55 to preserve heat therein. As used herein, coaxial means that one conduit is housed inside the other conduit and not necessarily that the conduits have a common center. In the preferred embodiment a common center for the return and delivery conduits 53, 55 does not necessarily exist because of the preferred flexible nature and inherent play in the coaxial feed line assembly which also allows for thermal expansion and small misalignments.

Figure 5:
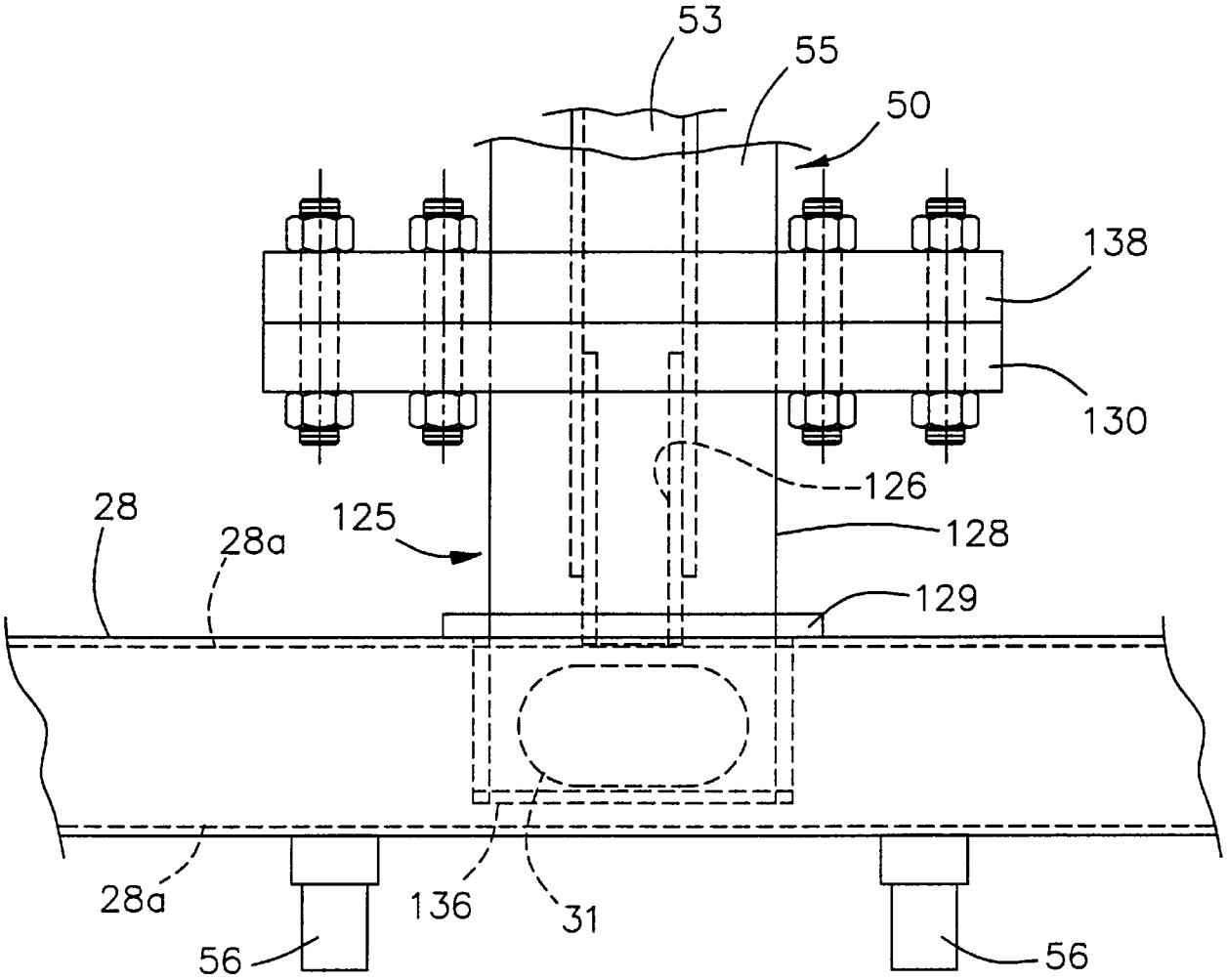
FIG. 5 is a top view of parts of the spray bar shown in FIG. 3.

Referring to FIGS. 3 and 5, the spray bar 28 also includes a coaxial inlet/outlet connection generally indicated at 125 that is preferably located in proximity to the center of is longitudinal axis of the spray bar 28. As shown, the spray bar 28 includes a divider 28*a* therein which splits the spray bar up into the upper and lower flow passages 58, 59. The coaxial connection 125 generally includes a inner duct 126 disposed within an outer duct 128. In greater detail, the inner duct 126 is welded or otherwise fixed to the spray bar 28 in fluid communication with the upper flow passage 58. The delivery conduit 53 is closely fitted into the inner duct 126 to connect the delivery conduit 53 with the upper flow passage 58. The outer duct 128 welded or otherwise fixed between two flanges 129, 130 to provide a chamber 132. The first flange 129 is fixed to the spray bar 28 and includes an flow aperture 134. A hollow body structure 136 is fixed between the first flange 129 and the spray bar 28 for connecting the flow aperture 134 to the bottom flow passage 59 thereby to provide for the spray bar outlet 31. The second flange 130 is fastened to a corresponding flange 138 of the return conduit 55 to connect the return conduit 55 to the outlet 31 and couple the feed line assembly 50 and spray bar 28.

Thus, there has been provided an IMPROVED FEED LINE ASSEMBLY AND ASPHALT CIRCULATION SYSTEM FOR ASPHALT DISTRIBUTOR which fully satisfies the objects, aims, and advantages set forth above. While the invention has been described in connection with a specific embodiment thereof, it is evident that may alternatives, modifications and variations will be apparent to those skilled in the art in light of the foregoing description. Accordingly, it is intended to embrace all such alternatives, modifications, and variations that fall within the spirit and broad scope of the appended claims.

What is claimed is:

1. An asphalt circulation system in an asphalt distributor having a tank for holding liquid asphalt and a pump in fluid communication with said tank for pumping asphalt, comprising:

a spray bar having a plurality of nozzles, an inlet and an outlet, the spray bar having a spraying mode wherein asphalt flows through the inlet and is discharged out of the nozzles and a circulation mode wherein asphalt flows from the inlet through the spray bar to the outlet;

a delivery conduit disposed transversely between the pump and the spray bar for one directional flow, the delivery conduit connected to the inlet and delivering pumped asphalt to the inlet during the spraying and circulation modes;

a return conduit disposed transversely between the spray bar and the tank for one directional flow, the return conduit connected to the outlet and returning asphalt from the outlet to the tank during the circulation mode, the return conduit running adjacent and in thermal communication with the delivery conduit forming a heat exchanger mechanism; and means for preventing asphalt from flowing through the return conduit during spraying mode, wherein asphalt is substantial static in the return conduit during spraying mode.

2. The asphalt circulation system of claim 1 wherein the return and delivery conduits are coaxially disposed.

3. The asphalt circulation system of claim 1 wherein the spray bar extends between first and second ends with the nozzles linearly arranged therebetween, the inlet fluidically connected by first and second flow passages to the first and second ends, respectively, the outlet connected by third and fourth flow passages to the first and second ends, respectively, whereby asphalt flows outward to the first and second ends and then inward to the outlet during the circulation mode, and wherein the spray bar as a center between the first and second ends, the inlet and the outlet located in close proximity to the center of the spray bar.

4. The asphalt circulation system of claim 1 wherein said means is interposed between the return conduit and the tank.

5. The asphalt circulation system of claim 1 wherein said means comprises a pressure relief valve interposed between the return conduit and the tank, the pressure relief valve being opened by high asphalt pressure during the circulation mode and being closed by lower asphalt pressure during the spraying mode.

6. The asphalt circulation system of claim 5 further comprising a directional control valve interposed between the pump and the delivery conduit, the directional control valve alternatively connecting the pump to the delivery conduit and the tank.

7. The asphalt circulation system of claim 6 further comprising a single valve body housing the directional control valve and the pressure relief valve, the valve body having a single return line connecting the directional control valve and the pressure relief valve to the tank.

8. An asphalt circulation system in an asphalt distributor having a tank for holding liquid asphalt and a pump in fluid communication with said tank for pumping asphalt, comprising:

a spray bar having a plurality of nozzles, an inlet and an outlet, the spray bar having a spraying mode wherein asphalt flows through the inlet and is discharged out of the nozzles and a circulation mode wherein asphalt flows from the inlet through the spray bar to the outlet;

a delivery conduit disposed transversely between the pump and the spray bar, the delivery conduit connected to the inlet and delivering pumped asphalt to the inlet during the spraying and circulation modes;

a return conduit disposed transversely between the spray bar and the tank, the return conduit connected to the outlet and returning asphalt from the outlet to the tank during the circulation mode, the return conduit running adjacent to the delivery conduit forming a heat exchanger mechanism; and a pressure relief valve connected to the return conduit, the pressure relief valve opening during said circulation mode to flow asphalt from the spray bar through return conduit and closing during said spraying mode to prevent asphalt from flowing through the return conduit.

9. The asphalt circulation system of claim 8 wherein residual asphalt remains in the return conduit at a substantially static state during the spraying mode, the heat exchanger mechanism transferring sufficient heat to prevent freezing of residual asphalt remaining in the return conduit during the spraying mode.

10. The asphalt circulation system of claim 8 wherein the return and delivery conduits are coaxially disposed.

11. The asphalt circulation system of claim 8 further comprising a directional control valve interposed between the pump and the delivery conduit, the directional control valve connecting the delivery conduit to the pump for circulation and spraying modes and connecting the pump with a bypass outlet to the tank for circulating asphalt in the tank during initial heating of the asphalt in the tank.

12. The asphalt circulation system of claim 8 wherein the spray bar extends between first and second ends with the nozzles linearly arranged therebetween, the inlet fluidically connected by first and second flow passages to the first and second ends, respectively, the outlet connected by third and fourth flow passages to the first and second ends, respectively, whereby asphalt flows outward to the first and second ends and then inward to the outlet during the circulation mode, and wherein the spray bar has a center between the first and second ends, the inlet and the outlet being located in close proximity to the center of the spray bar.

13. The asphalt circulation system of claim 8 wherein the pressure relief valve is interposed between the return conduit and the tank.

14. An asphalt circulation system in an asphalt distributor having a tank for holding liquid asphalt and a pump is communication with said tank for pumping asphalt, comprising:

a spray bar having a plurality of nozzles for discharging liquid asphalt;

a first conduit disposed transversely between the spray bar and the pump for communicating asphalt therebetween; and a second conduit disposed transversely between the spray bar and the tank for communicating asphalt therebetween, the first and second conduits disposed coaxially thereby limiting the amount of exposed plumbing and forming a heat exchanger mechanism to transfer heat therebetween to prevent freezing of asphalt.

15. The feed line assembly of claim 14 wherein the asphalt distributor has spraying and circulation modes, asphalt flowing from the pump through the first conduit to spray bar in both of the spraying and circulation modes, asphalt flowing from the spray bar through the second conduit to the tank in the circulation mode.

16. The feed line assembly of claim 14 wherein asphalt is substantially static in the second conduit during said spraying mode.

17. The asphalt circulation system of claim 14 wherein the first and second conduits are connected to the spray bar at the same location.

18. The asphalt circulation system of claim 14 wherein the first and second conduits are connected to the approximate center of the spray bar.

19. The asphalt circulating system of claim 14 wherein the first and second conduits comprise flexible metal tubing.

* * * * *

UNITED STATES PATENT AND TRADEMARK OFFICE

CERTIFICATE OF CORRECTION

PATENT NO. : 6,161,775

DATED : January 5, 2001

INVENTOR(S) : Thomas R. Brown, Jeremy Heller and Patrick O'Brien

It is certified that error appears in the above-identified patent and that said Letters Patent is hereby corrected as shown below:

ON THE TITLE PAGE

Inventor "Jeremey Heller", change to "Jeremy Heller"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,161,775
DATED : December 19, 2000
INVENTOR(S) : Thomas R. Brown, et al.

It is certified that error appears in the above-identified patent and that said Letters Patent is hereby corrected as shown below:

Abstract,
Line 12, replace "circulation" with -- "spraying" --.

Column 5,
Detailed Description of the Preferred Embodiment,
Line 39, replace "circulation" with -- spraying --.

Signed and Sealed this

Sixth Day of November, 2001

*Attest:*

Nicholas P. Godici

*Attesting Officer*

NICHOLAS P. GODICI
*Acting Director of the United States Patent and Trademark Office*